US006820533B2

(12) United States Patent
Schuerman

(10) Patent No.: US 6,820,533 B2
(45) Date of Patent: Nov. 23, 2004

(54) BOLT ACTION RIFLE

(76) Inventor: Dale Schuerman, 9301 E. Adobe Dr., Scottsdale, AZ (US) 83233

( * ) Notice: Subject to any disclaimer, the term of this patent is extended or adjusted under 35 U.S.C. 154(b) by 0 days.

(21) Appl. No.: 10/122,165

(22) Filed: Apr. 15, 2002

(65) Prior Publication Data

US 2003/0089014 A1 May 15, 2003

Related U.S. Application Data

(60) Provisional application No. 60/338,043, filed on Nov. 13, 2001, now abandoned.

(51) Int. Cl.[7] ..... F41A 3/40

(52) U.S. Cl. ..... 89/190; 89/187.01; 89/189

(58) Field of Search ..... 89/168, 170, 173, 89/175, 176, 180, 181, 187.01, 189, 190, 199; 42/75.02, 75.03

(56) References Cited

U.S. PATENT DOCUMENTS 884,065 A * 4/1908 Brauning
1,095,738 A * 5/1914 Rostel
1,096,615 A * 5/1914 Febiger
1,396,832 A * 11/1921 Graham
2,775,166 A * 12/1956 Janson ..... 89/191
2,861,374 A * 11/1958 Hampton ..... 42/16
4,815,356 A * 3/1989 Hupp et al. ..... 89/190

FOREIGN PATENT DOCUMENTS

DK 17887 * 9/1913 ..... 89/176

* cited by examiner

*Primary Examiner*—Stephen M. Johnson
(74) *Attorney, Agent, or Firm*—Jeffrey Weiss; Harry M. Weiss; Weiss, Moy & Harris, P.C.

(57) ABSTRACT

An improved bolt action rifle. In its preferred embodiment, the improved bolt action rifle has at least one locking lug positioned within the bolt and having at its bottom a convex projection adapted to be inserted into a mating convex slot; a locking lug safety plunger located adjacent to a locking lug and adapted to prevent full insertion of the bolt without the presence of the locking lug; a bolt handle lock to lock the bolt in an upright position when the bolt handle is pulled rearward of the receiver; a bolt handle positioning detent to hold the bolt in a downward firing position when the rifle is in condition to be fired; a split receiver ring having two openings, one for permitting the ejection of a cartridge and the other for permitting the insertion of a new cartridge from the magazine; a bolt sleeve lock for locking together portions of the bolt; an ambidextrous magazine release; a magazine ejector; and an improved trigger mechanism based on the use of studs instead of pins.

17 Claims, 10 Drawing Sheets

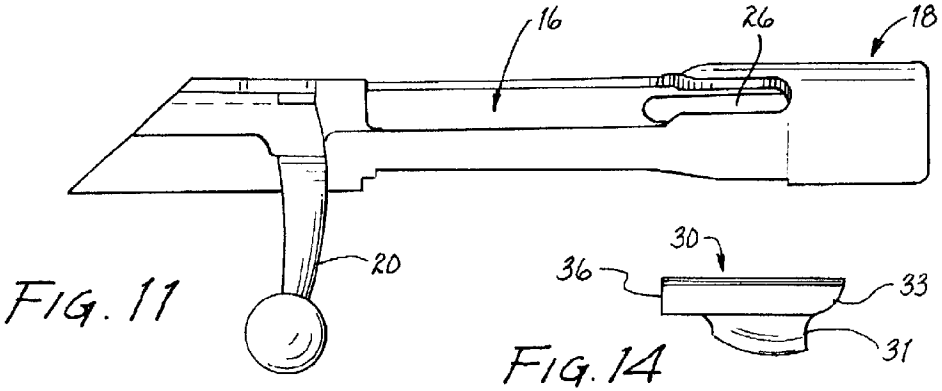
FIG. 11
FIG. 14
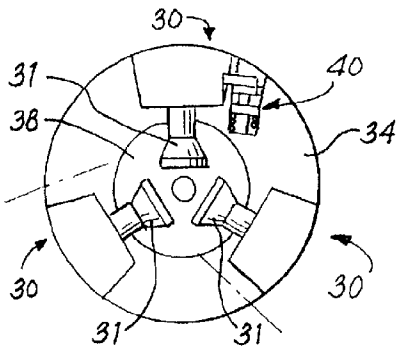
FIG. 12
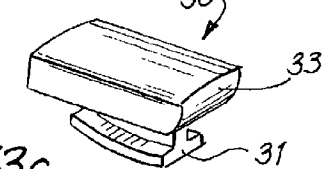
FIG. 13C
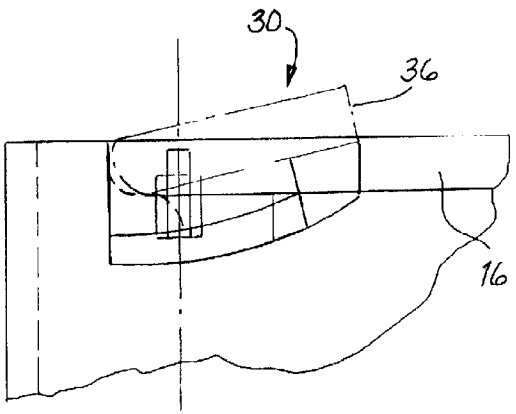
FIG. 12A
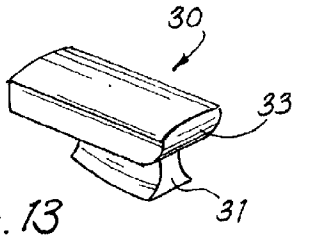
FIG. 13
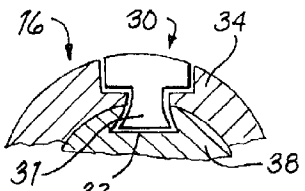
FIG. 15
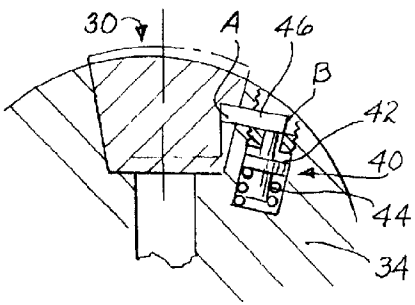
FIG. 12B

BOLT ACTION RIFLE

RELATED APPLICATION

This non-provisional application claims priority from Provisional Application No. 60/338,043 filed on Nov. 13, 2001 now abandoned.

BACKGROUND OF THE INVENTION

1. Field of Invention

This invention relates generally to bolt action rifles and, more specifically, to a bolt action rifle having improved functionality with respect to the bolt, receiver, trigger, and magazine components thereof.

2. Description of the Related Art

Rifles of the bolt action variety are well known. In a bolt action rifle, bullets are fed into the receiver, typically from a magazine, and by manipulation of a bolt handle are driven forward by a bolt into the chamber. After firing, the bolt is retracted and the spent casing is ejected.

There are a number of deficiencies associated with prior art bolt action rifles, however. For example, prior art bolt action rifles typically having locking lugs positioned on the bolt. These act to maintain the bolt in position during firing, and are required because of the breech pressure generated when a bullet is fired. However, prior art locking lugs can cause interference and binding during sliding of the bolt.

In addition, in a typical bolt-action rifle, the magazine or cartridge feed is accomplished behind the receiver ring. The front of the cartridge must then feed forward from behind the receiver ring into the chamber. This requires, in turn, a relatively long feed ramp which will direct the cartridge from the magazine into the chamber. The distance which the cartridge must traverse on the way to the chamber provides potential areas for cartridge jams or malfunctions.

Still further, the magazines on prior art bolt action rifles are typically releasable by the depression of a magazine release button found on one side of the magazine. However, the placement of the magazine release button may be inconvenient for certain users, including for example left-handed users. Moreover, even following depression of a magazine release, it can be difficult for the user to securely grasp and remove the magazine from its housing.

Trigger mechanisms on prior art bolt action rifles also suffer from deficiencies. For example, certain trigger components are pivoting, and these typically pivot about a pin that is inserted through the trigger housing and the pivoting part itself. These pins can be subject to loosening, shifting, or breaking as a result of use.

U.S. Pat. No. 4,920,677, issued to applicant herein and incorporated herein by reference, represents an effort to addresses some, though not all, of these issues.

A need therefore existed for a bolt action rifle having improved functionality in the areas of bolt, receiver, trigger, and magazine design. The present invention satisfies these needs and provides other, related, advantages.

SUMMARY OF THE INVENTION

It is an object of the present invention to provide an improved bolt action rifle.

It is a further object of the present invention to provide a bolt action rifle having improved locking lugs.

It is a yet further object of the present invention to provide a bolt action rifle having locking lugs that are less subject to binding and interference than prior art locking lugs.

It is a still further object of the present invention to provide a bolt handle that resists unintended downward movement when the bolt is in the open position.

It is a further object of the present invention to provide a bolt handle that resists unintended upward movement when the bolt is in the closed position.

It is another object of the present invention to provide a bolt action rifle having a split receiver ring, permitting the elimination of a cartridge feed ramp and shortening bolt travel from front to rear.

It is a further object of the present invention to provide a bolt action rifle having an ambidextrous magazine release.

It is another object of the present invention to provide a bolt action rifle having an improved trigger assembly, eliminating the need for pivot pins.

BRIEF DESCRIPTION OF THE PREFERRED EMBODIMENTS

In accordance with one embodiment of the present invention, an improved bolt action rifle is disclosed. The improved bolt action rifle comprises, in combination: a stock; a receiver mounted in the stock; a trigger assembly mounted in the receiver; a receiver ring located at a forward end of the receiver; a barrel located at a forward end of the receiver ring; a bolt enclosed within the receiver and the receiver ring and adapted to travel forward and rearward within the receiver and the receiver ring; wherein the bolt further comprises an inner bolt sleeve and an outer bolt sleeve surrounding the inner bolt sleeve; at least one locking lug slot located within the inner bolt sleeve; wherein the locking lug slot is concave; at least one locking lug having an upper portion and a lower projection wherein the upper portion is dimensioned to be retained within a cavity in the outer bolt sleeve and wherein the lower projection is dimensioned to be mounted within the locking lug slot; wherein the lower projection is convex; wherein the upper portion is dimensioned to contact a mating recessed area within the receiver ring during axial movement of the inner bolt sleeve relative to the outer bolt sleeve.

In accordance with another embodiment of the present invention, an improved bolt action rifle is disclosed. The improved bolt action rifle comprises, in combination: a stock; a receiver mounted in the stock; a trigger assembly mounted in the receiver; a receiver ring located at a forward end of the receiver; a barrel located at a forward end of the receiver ring; a bolt enclosed within the receiver and the receiver ring and adapted to travel forward and rearward within the receiver and the receiver ring; wherein the bolt further comprises an inner bolt sleeve and an outer bolt sleeve surrounding the inner bolt sleeve; at least one locking lug slot located within the inner bolt sleeve; at least one locking lug having an upper portion and a lower projection wherein the upper portion is dimensioned to be retained within a cavity in the outer bolt sleeve and wherein the lower projection is dimensioned to be mounted within the locking lug slot; wherein the upper portion is dimensioned to contact a mating recessed area within the receiver ring during axial movement of the inner bolt sleeve relative to the outer bolt sleeve; and means for preventing full forward movement of the bolt within the receiver and the receiver ring when the upper portion of the at least one locking lug is not present within the cavity in the outer bolt sleeve.

In accordance with another embodiment of the present invention, an improved bolt action rifle is disclosed. The bolt action rifle comprises, in combination: a stock; a receiver mounted in the stock; a trigger assembly mounted in the receiver; a receiver ring located at a forward end of the receiver; a barrel located at a forward end of the receiver ring; a bolt enclosed within the receiver and the receiver ring and adapted to travel forward and rearward within the receiver and the receiver ring; a first cut-out area in a side portion of the receiver ring; wherein the first cut-out area is dimensioned and positioned to permit the ejection of a cartridge therethrough; a second cut-out area in a bottom portion of the receiver ring; wherein the second cut-out area is dimensioned and positioned to permit the feeding of a new cartridge from a magazine therebelow.

In accordance with yet another embodiment of the present invention, an improved bolt action rifle is disclosed. The improved bolt action rifle comprises, in combination: a stock; a receiver mounted in the stock; a trigger assembly mounted in the receiver; a receiver ring located at a forward end of the receiver; a barrel located at a forward end of the receiver ring; a bolt enclosed within the receiver and the receiver ring and adapted to travel forward and rearward within the receiver and the receiver ring; a bolt handle collar positioned on the bolt; a bolt handle projecting outward from the bolt handle collar to be grasped by a user seeking to cause one of forward and rearward movement of the bolt within the receiver and the receiver ring; and means for locking the bolt handle in an upward position so that the bolt handle will not contact a rearward portion of the receiver during forward movement of the bolt and for unlocking the bolt handle from the upward position after the bolt handle has cleared the rearward position of the receiver.

In accordance with still another embodiment of the present invention, an improved bolt action rifle is disclosed. The improved bolt action rifle comprises, in combination: a stock; a receiver mounted in the stock; a bolt handle opening in the stock; a trigger assembly mounted in the receiver; a receiver ring located at a forward end of the receiver; a barrel located at a forward end of the receiver ring; a bolt enclosed within the receiver and the receiver ring and adapted to travel forward and rearward within the receiver and the receiver ring; a bolt handle collar positioned on the bolt; a bolt handle projecting outward from the bolt handle collar to be grasped by a user seeking to cause one of forward and rearward movement of the bolt within the receiver and the receiver ring and adapted to be received within the bolt handle opening in the stock when the bolt handle is rotated downward so as to lock the bolt in a firing position; and means for holding the bolt handle in a downward firing position within the bolt handle opening.

In accordance with yet another embodiment of the present invention, an improved bolt action rifle is disclosed. The improved bolt action rifle comprises, in combination: a stock; a receiver mounted in the stock; a bolt handle opening in the stock; a trigger assembly mounted in the receiver; a receiver ring located at a forward end of the receiver; a barrel located at a forward end of the receiver ring; a bolt enclosed within the receiver and the receiver ring and adapted to travel forward and rearward within the receiver and the receiver ring; wherein the bolt further comprises an inner bolt sleeve and an outer bolt sleeve surrounding the inner bolt sleeve; wherein the bolt further comprises a rear bolt sleeve threadably coupled to the outer bolt sleeve; and bolt sleeve locking means for locking the rear bolt sleeve to the outer bolt sleeve.

In accordance with still another embodiment of the present invention, an improved firearm is disclosed. The improved firearm comprises, in combination: a frame; a trigger assembly mounted in the frame; a chamber; a magazine coupled to the frame and adapted to feed a cartridge into the chamber for firing; and means for releasing the magazine from the frame; wherein the releasing means comprises a first button projecting from a first side of the frame and a second button projecting from a second side of the frame and wherein depression of either of the first and the second button permits detachment of the magazine from the frame.

In accordance with another embodiment of the present invention, an improved firearm is disclosed. The improved firearm comprises, in combination: a frame; and a trigger assembly mounted in the frame; wherein the trigger assembly comprises: a first plate; a second plate positioned opposite the first plate; a first pivot point about which pivots a trigger sear; a second pivot point about which pivots a trigger piece; a third pivot point about which pivots a safety pawl; wherein each of the first pivot point, the second pivot point and the third pivot point comprises a stud projecting from each side of the trigger sear, the trigger piece, and the safety pawl and dimensioned to be inserted into mating openings in the first plate and the second plate.

In accordance with another embodiment of the present invention, an improved bolt action rifle is disclosed. The improved bolt action rifle comprises, in combination: a stock; a receiver mounted in the stock; a bolt handle opening in the stock; a trigger assembly mounted in the receiver; wherein the trigger assembly comprises: a first plate; a second plate positioned opposite the first plate; a first pivot point about which pivots a trigger sear; a second pivot point about which pivots a trigger piece; a third pivot point about which pivots a safety pawl; wherein each of the first pivot point, the second pivot point and the third pivot point comprises a stud projecting from each side of the trigger sear, the trigger piece, and the safety pawl and dimensioned to be inserted into mating openings in the first plate and the second plate; a magazine insertable into a housing located in the stock and adapted to feed a cartridge into the receiver for firing; means for releasing the magazine from the housing; wherein the releasing means comprises a first button projecting from a first side of the housing and a second button projecting from a second side of the housing and wherein depression of either of the first and the second button permits detachment of the magazine from the housing; a receiver ring located at a forward end of the receiver; a first cut-out area in a side portion of the receiver ring; wherein the first cut-out area is dimensioned and positioned to permit the ejection of a cartridge therethrough; a second cut-out area in a bottom portion of the receiver ring; wherein the second cut-out area is dimensioned and positioned to permit the feeding of a new cartridge from a magazine therebelow; a barrel located at a forward end of the receiver ring; a bolt enclosed within the receiver and the receiver ring and adapted to travel forward and rearward within the receiver and the receiver ring; wherein the bolt further comprises an inner bolt sleeve and an outer bolt sleeve surrounding the inner bolt sleeve; wherein the bolt further comprises a rear bolt sleeve threadably coupled to the outer bolt sleeve; bolt sleeve locking means for locking the rear bolt sleeve to the outer bolt sleeve; a bolt handle collar positioned on the bolt; a bolt handle projecting outward from the bolt handle collar to be grasped by a user seeking to cause one of forward and rearward movement of the bolt within the receiver and the receiver ring; means for locking the bolt handle in an upward position so that the bolt handle will not contact a rearward portion of the receiver during forward movement of the bolt and for unlocking the bolt handle from the upward position after the bolt handle has cleared the rearward position of the receiver; at least one locking lug slot located within the inner bolt sleeve; wherein the locking lug slot is concave; at least one locking lug having an upper portion and a lower projection wherein the upper portion is dimensioned to be retained within a cavity in the outer bolt sleeve and wherein the lower projection is dimensioned to be mounted within the locking lug slot; wherein the lower projection is convex; wherein the upper portion is dimensioned to contact a mating recessed area within the receiver ring during axial movement of the inner bolt sleeve relative to the outer bolt sleeve; means for preventing full forward movement of the bolt within the receiver and the receiver ring when the upper portion of the at least one locking lug is not present within the cavity in the outer bolt sleeve; and means for holding the bolt handle in a downward firing position within the bolt handle opening.

The foregoing and other objects, features, and advantages of the invention will be apparent from the following, more particular, description of the preferred embodiments of the invention, as illustrated in the accompanying drawings.

BRIEF DESCRIPTION OF THE DRAWINGS

FIG. 11 is a side view of the receiver and receiver ring portion of an embodiment of the bolt action rifle of the present invention, with the bolt inserted.

FIG. 12 is an end, cross-sectional view of a locking lug safety assembly.

FIG. 12A is a side, cross-sectional view of a locking lug projecting from the bolt.

FIG. 12B is an end, cross-sectional view of locking lug safety assembly with a locking lug in position.

FIG. 13 is a perspective view of an embodiment of a locking lug.

FIG. 13C is a perspective view of an embodiment of a locking lug.

FIG. 14 is a side view of an embodiment of a locking lug.

FIG. 15 is an end, cross-sectional view of a locking lug in position relative to the inner and outer bolt sleeves of a bolt.

DETAILED DESCRIPTION OF THE PREFERRED EMBODIMENTS

Figure 1:
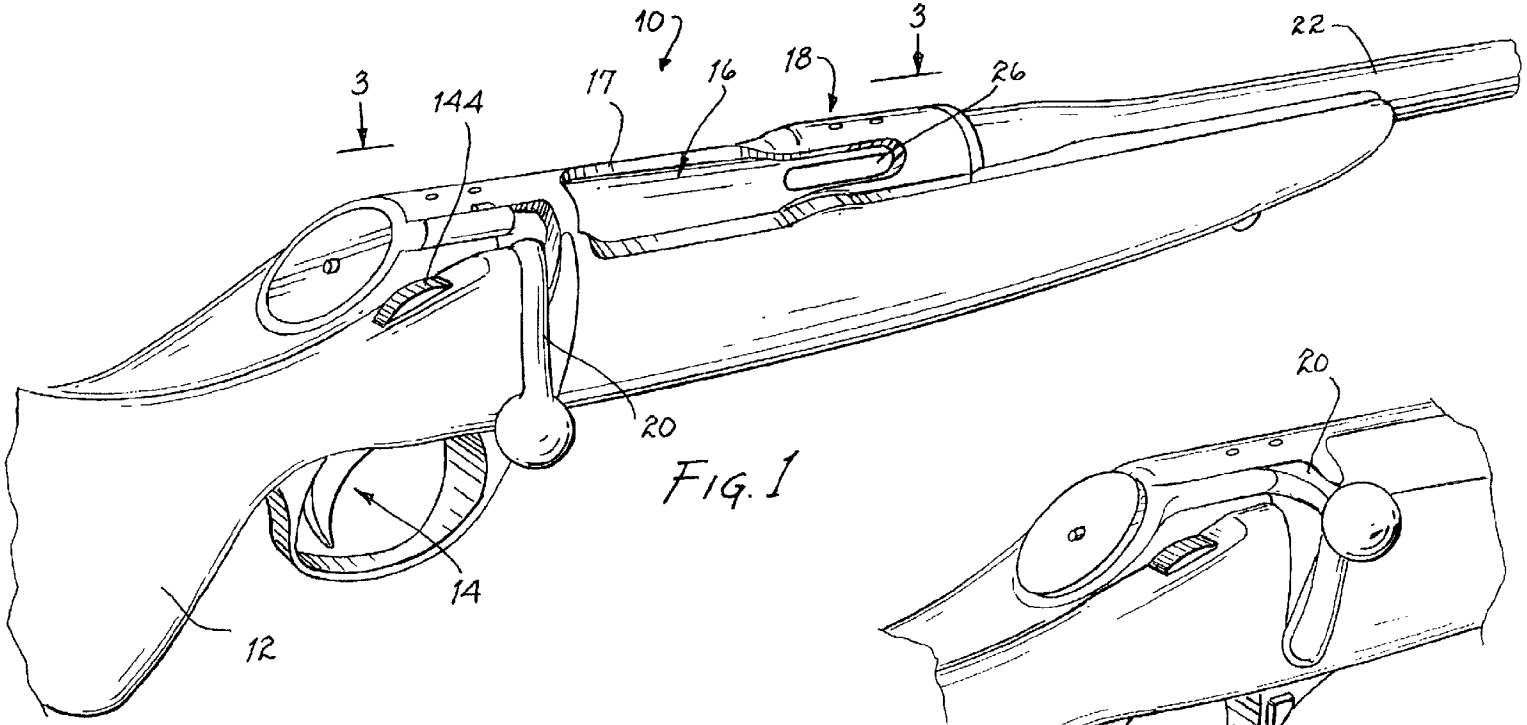
FIG. 1 is a fragmentary, perspective view of an embodiment of the bolt action rifle of the present invention.
Figure 2:
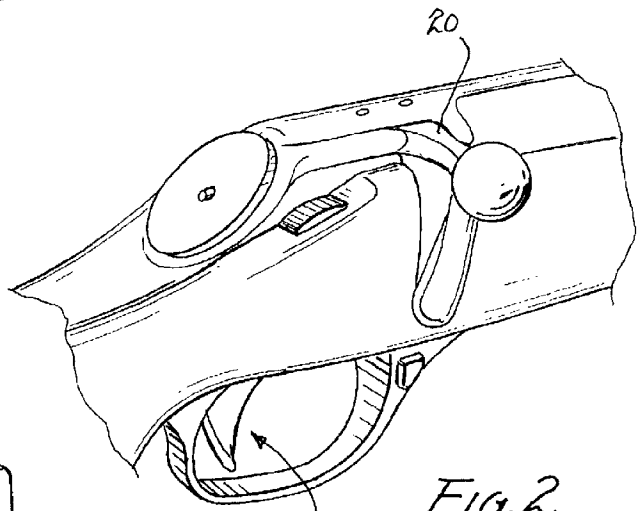
FIG. 2 is perspective view of the trigger and bolt handle portion of an embodiment of the bolt action rifle of the present invention.
Figure 3:
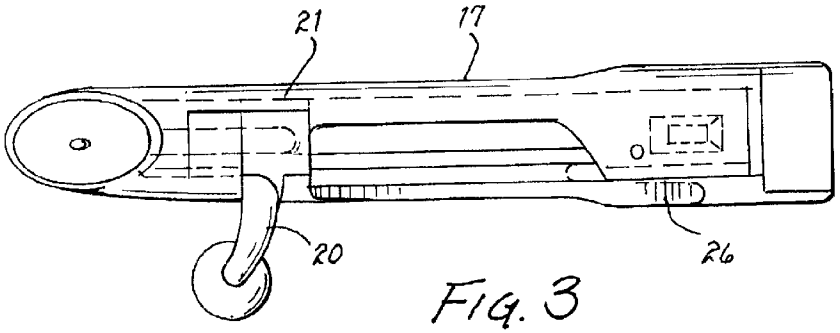
FIG. 3 is a top view of the receiver portion of an embodiment of the bolt action rifle of the present invention.
Figure 5:
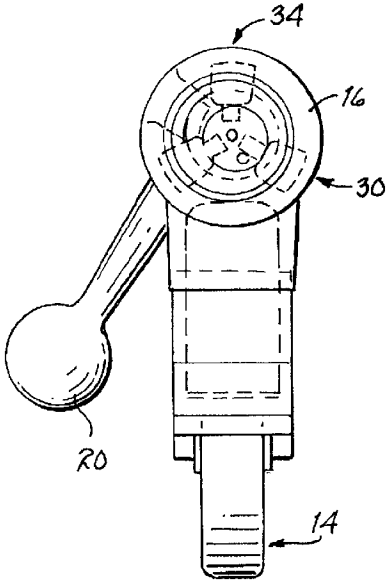
FIG. 5 is a front, end, cross-sectional view of an embodiment of the bolt action rifle of the present invention, showing the position of locking lugs on the bolt.
Figure 4C:
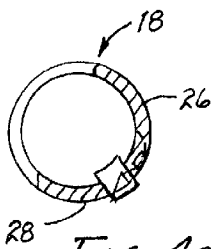
FIG. 4C is a cross-sectional end view of the receiver ring portion of an embodiment of the bolt action rifle of the present invention.
Figure 4:
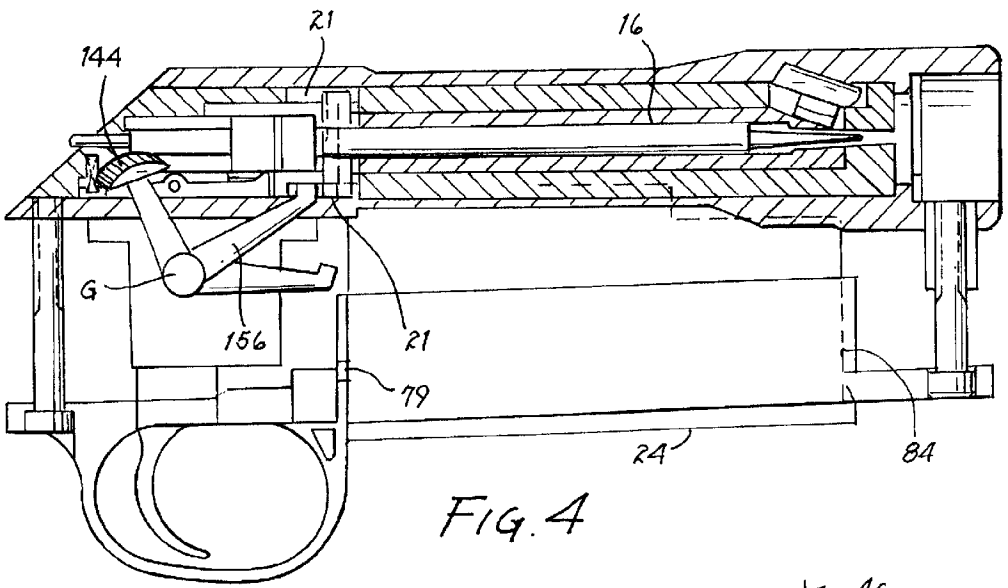
FIG. 4 is a side, cross-sectional view of an embodiment of the bolt action rifle of the present invention, showing the bolt, trigger, safety lever and magazine portions.
Figure 4A:
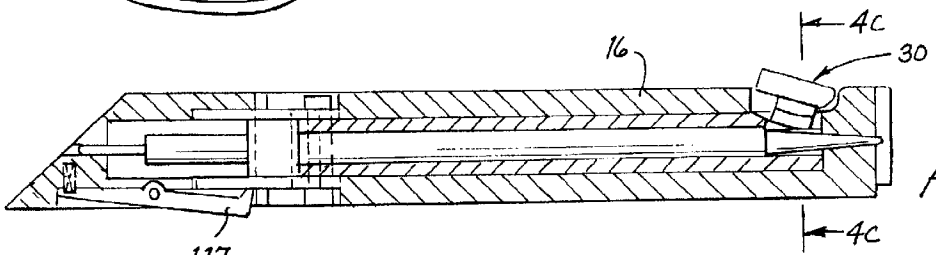
FIG. 4A is a side, cross-sectional view of an embodiment of the bolt action rifle of the present invention, showing the bolt portion, including a locking lug and bolt sear.
Figure 4B:
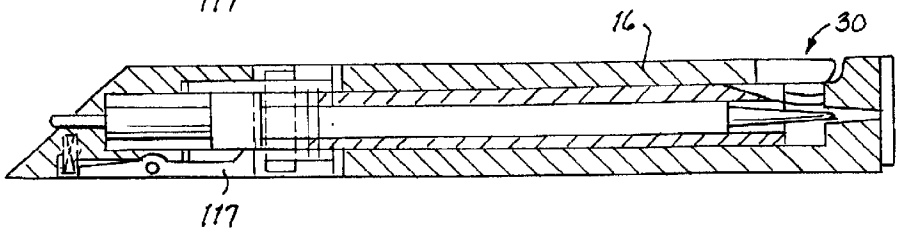
FIG. 4B is a side, cross-sectional view of an embodiment of the bolt action rifle of the present invention, showing the bolt portion, including a locking lug and bolt sear.

Referring first to FIG. 1, the rifle 10 of the present invention is shown in perspective view. The rifle 10 is of the bolt-action variety, and its main components include a stock 12, a trigger assembly 14, a bolt 16, a receiver 17, receiver ring 18, a bolt handle 20, a barrel 22, and a magazine 24 (see FIG. 4).

Turning first to the receiver 17, the purpose of a receiver on a bolt-action rifle is generally to provide an enclosure which will receive a cartridge and which contains the bolt which inserts the cartridge into the barrel for discharge. The receiver ring further acts, on a typical bolt-action rifle, to contain the locking lugs, which are rigidly part of the rotating bolt. Prior art receiver rings are completely enclosed, with the locking lug recesses located ahead of the magazine.

In the typical bolt-action rifle, the magazine or cartridge feed is accomplished behind the receiver ring. The front of the cartridge must then feed forward from behind the receiver ring into the chamber. This requires, in turn, a relatively long feed ramp which will direct the cartridge from the magazine into the chamber. The distance which the cartridge must traverse on the way to the chamber provides potential areas for cartridge jams or malfunctions.

In the rifle 10 of the present invention, the receiver ring 18 has a split design, and comprises a first cut-out area 26 on a side portion thereof and a second cut-out area 28 (see FIG. 4C) on a bottom portion thereof. The first cut-out area 26 permits the ejection of the cartridge (not shown) more proximate the barrel 22 end of the rifle 10, as compared to prior art bolt-action rifles. The second cut-out area 28 allows the feeding of a new cartridge (not shown) from the magazine 24 therethrough, eliminating the need for a feed ramp. Shortening the distance the cartridge must travel on the way to the chamber eliminates the need for a feed ramp and permits more direct feeding of the cartridge into the chamber. This reduces the possibility of jamming.

In combination, the first cut-out area 26 and second cut-out area 28 permit a material shortening of the length of the action, potentially by about one inch. This reduces the weight of the rifle 10 and makes the action more rigid, increasing shooting accuracy. This reduces the required bolt travel to feed and eject the cartridge.

Referring now to FIGS. 4A, 4B, and 12*a*–15, the configuration and function of different embodiments of the locking lugs of the present invention are illustrated. A typical prior art bolt-action rifle, at least of the center-fire variety, has two or more locking lugs located on a front portion of the bolt, which rotate into matching recesses milled into the receiver ring. The locking lugs help maintain the bolt in position during firing, and are required because of the breech pressure generated during firing. (Because of the lower breech pressures generated during firing of a rimfire cartridge, bolt-action rifles of this type often do not have locking lugs on the bolt.)

Referring first to FIGS. 4A, 4B, 12A and 15, each locking lug 30 is pivotally mounted within the bolt 16, in such manner that the surface of the locking lug 30 is substantially flush with that of the bolt 16 so that the locking lugs 30 will not interfere with the passage of the front portion of the bolt 16 into the receiver 17 as the bolt 16 is moved forward into the firing position. Each locking lug 30 comprises a dovetail projection 31 (see FIG. 13) and an upper portion 33, the surface of which upper portion 33 is flush with that of the bolt 16 when the bolt 16 is in the open, non-firing position.

The upper portion 33 of each locking lug 30 is positioned within a recess within an outer bolt sleeve 34. See FIGS. 12, 15. The dovetail projection 31 is mounted within a dovetail slot 32 in an inner bolt sleeve 38 (see FIG. 13B). Axial movement of the inner bolt sleeve 38 relative to the outer bolt sleeve 34, caused by the rotation of the bolt handle 20 into the closed/firing position, in turn causes each locking lug 30 to pivot rearward and upward along the dovetail slot 32, until a rear surface 36 of the upper portion 33 of the locking lug 30 contacts a mating recessed area (see FIG. 13A) within the receiver ring 18. When the bolt handle 20 is rotated into the open position after firing to eject the spent cartridge, axial movement of the inner bolt sleeve 38 rearward relative to the outer bolt sleeve 34 in the opposite direction causes each locking lug 30 to pivot forward and downward along the dovetail slot 32 until the surface of the locking lug 30 is again flush with the surface of the bolt 16, permitting the portion of the bolt 16 containing locking lugs 30 to pass within the receiver 17.

Particular attention is now directed to the dovetail slot 32. As shown particularly in FIGS. 12A and 13B, the dovetail slot 32 is curved and has a concave configuration, and the mating surface of the dovetail projection 31 is correspondingly and matingly curved in a convex configuration. This curvature provides increased and more uniform contact between the dovetail slot 32 and dovetail projection 31 during motion of the locking lug 30. As a result, there is less interference and binding during sliding of the inner bolt sleeve 38. This configuration also permits a shallower dovetail slot 32, thus permitting the locking lug 30 to have a shorter dovetail projection 31.

Referring now to FIGS. 12, 13 and 15, in one embodiment, the locking lug 30 has a dovetail projection 31 which has, when viewed from an end thereof, a substantially dove-tail shape. Referring to FIG. 13C, in another embodiment, the locking lug 30 has a dovetail projection 31 which has a substantially T-shape cross-section. Whether the tail portion is T or dove-tail shaped, the bottom portion thereof is convex, so as to mate with a corresponding concave dovetail or T-shaped slot.

As noted above, the locking lugs 30 are required because of the breech pressure generated during firing. In particular, the locking lugs 30 transfer the force of recoil from the head of the bolt 16 to the receiver ring 18.

Attention is now directed to FIGS. 12, 12A, 12B, and 12C. To prevent a user from firing the rifle 10 without the locking lugs 30, it is preferable to position a lug safety assembly 40 proximate at least one of the locking lugs 30. The lug safety assembly 40 preferably consists of a plunger 42, the base of which is biased against a spring 44. At the top of the plunger 42, opposite the spring 44, is a projection 46. The projection 46 is dimensioned to extend on first side A into the recess in the outer bolt sleeve 34 into which the upper portion 33 of the locking lug 30 is positioned. When the locking lug 30 is positioned within the bolt 16, the upper portion 33 contacts the projection 46, depressing the plunger 42. (See FIG. 12B). When the locking lug 30 is not in position, the plunger 42 will be fully extended, which will cause second side B of the projection 46 to extend outside the outer bolt sleeve 34 (see FIG. 12C), preventing the outer bolt sleeve 34 from entering the receiver 18 and thus preventing the firing of the rifle 10 without the locking lug 30.

Figure 11B:
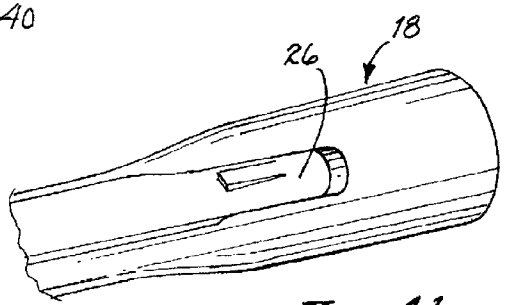
FIG. 11B is a perspective view of the receiver ring portion of an embodiment of the bolt action rifle of the present invention, without the bolt.
Figure 11A:
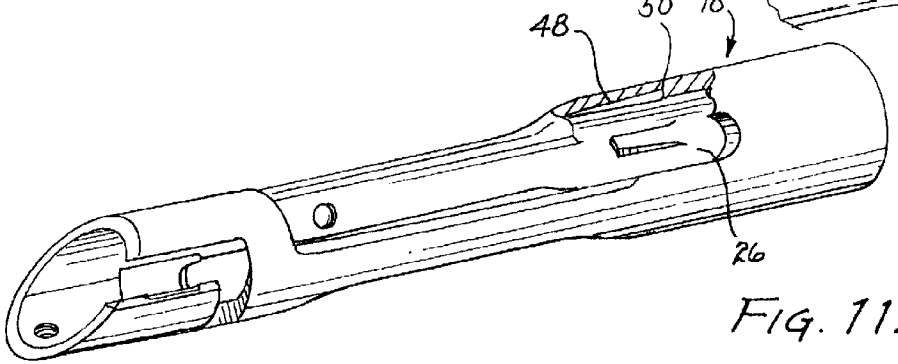
FIG. 11A is a perspective view of the receiver and receiver ring portion of an embodiment of the bolt action rifle of the present invention, without the bolt.
Figure 13A:
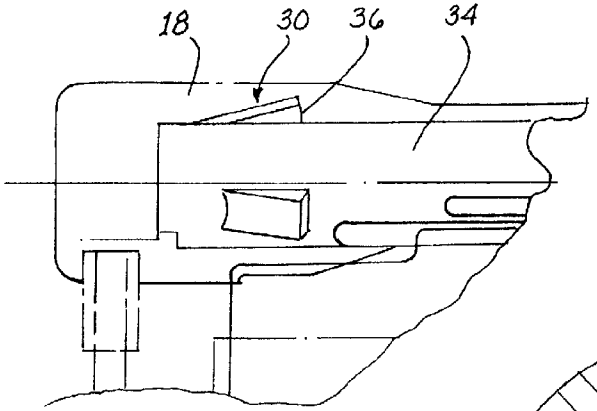
FIG. 13A is a side view of locking lugs projecting from the outer bolt sleeve of the bolt.
Figure 19:
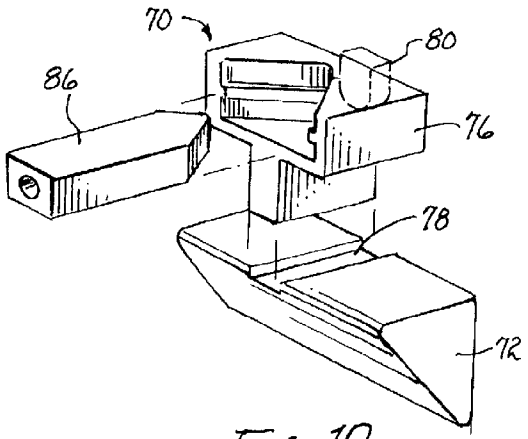
FIG. 19 is an exploded, perspective view of the magazine release portion of an embodiment of the bolt action rifle of the present invention.
Figure 18:
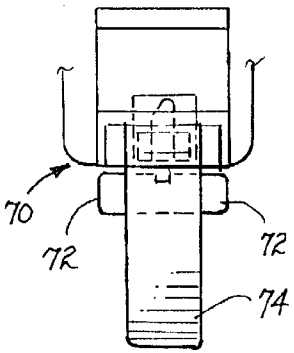
FIG. 18 is a front, end view of the magazine release portion of an embodiment of the bolt action rifle of the present invention.
Figure 16:
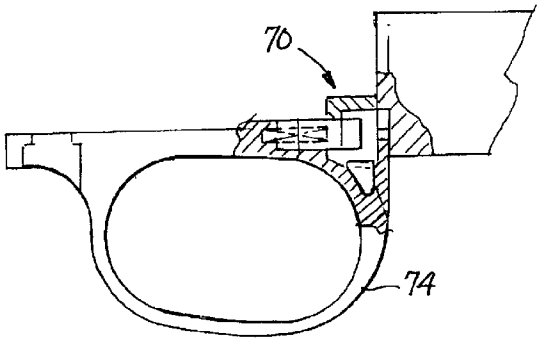
FIG. 16 is a side, cross-sectional view of a trigger guard and magazine release.
Figure 17:
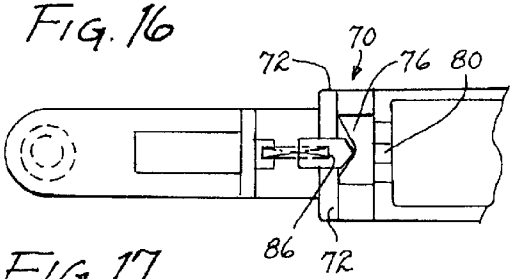
FIG. 17 is a top view of a the magazine release portion of an embodiment of the bolt action rifle of the present invention.
Figure 20:
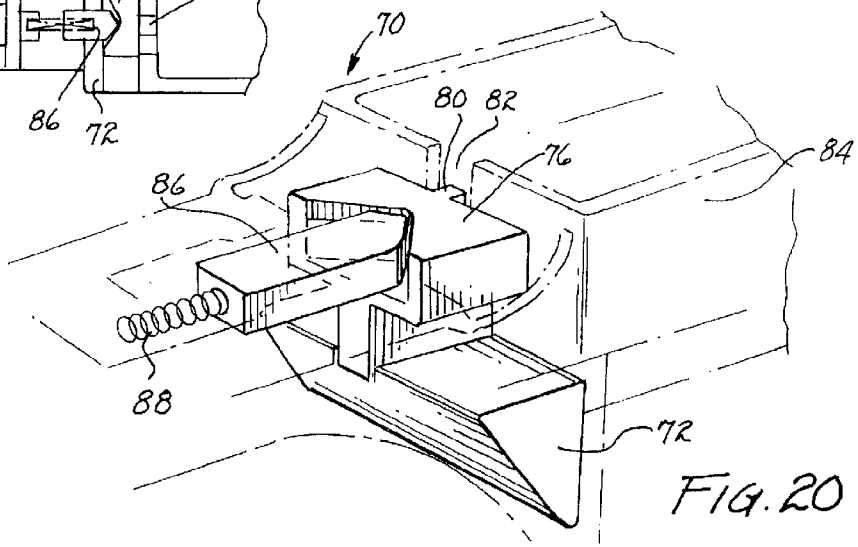
FIG. 20 is a cut-away, perspective view of the magazine release portion of an embodiment of the bolt action rifle of the present invention.

Referring now to FIG. 11A, to guard against the possibility that a user might try to insert the bolt 16 into the receiver 18 without a locking lug 30 by simply manually depressing the projection 46, a channel 48 is provided in the receiver 18. The channel 48 is dimensioned to receive the projection 46 after the projection 46 enters the receiver 18. The depth of the channel 48 increases as the projection 46 travels toward the barrel 22 end of the rifle 10, permitting the projection 46 to extend further as the bolt 16 travels forward. At the end of the channel 48 is a wall 50, which wall 50 will act to prevent the passage of the projection 46—and thus prevent the complete insertion of the bolt 16 and the firing of the rifle 10 without the locking lug 30.

It would be possible, without departing from the spirit or scope of the present invention, to provide other means for preventing the complete insertion of the bolt 16 and the firing of the rifle 10 without the locking lug 30. The locking lug safety assembly 46 is only intended to be illustrative of one such means for preventing such insertion.

To retract the bolt 16, it is necessary to raise the bolt handle 20 to its uppermost position, and then pull back on the bolt handle 20, causing the bolt 16 to retract and eject any spent cartridge from the chamber. As the bolt handle 20 is retracted through the slot on the rear of the action, the action will prevent the lowering of the bolt handle 20. However, once the bolt handle 20 clears the action, the bolt handle 20 is free to rotate downward. However, because the bolt 16 cannot be moved forward when the bolt handle 20 is in the downward position outside of the action—the action will block the bolt handle 20 from moving forward—a user would be prevented from rapidly repositioning the bolt 16 to fire the rifle 12.

Figure 8:
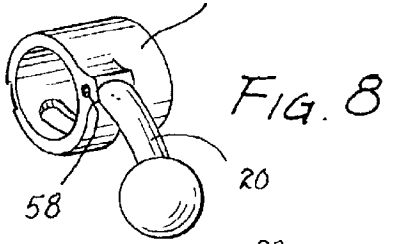
FIG. 8 is a perspective view of the bolt handle collar and bolt handle of an embodiment of the bolt action rifle of the present invention.
Figure 10:
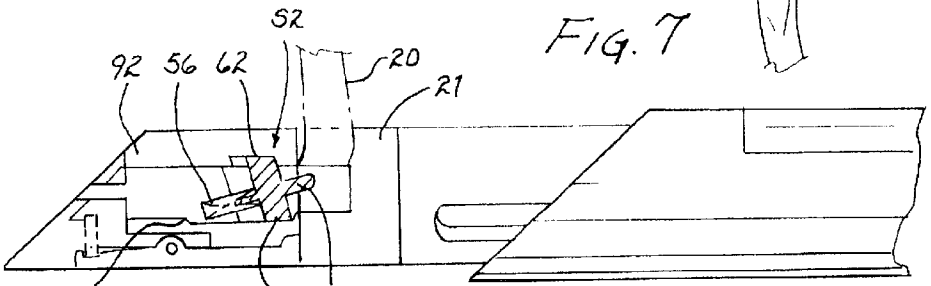
FIG. 10 is a side, cross-sectional view of the bolt portion of an embodiment of the bolt action rifle of the present invention, illustrating a bolt handle lock.
Figure 9:
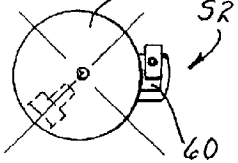
FIG. 9 is an end, cross-sectional view of the rear bolt sleeve of an embodiment of the bolt action rifle of the present invention.
Figure 13B:
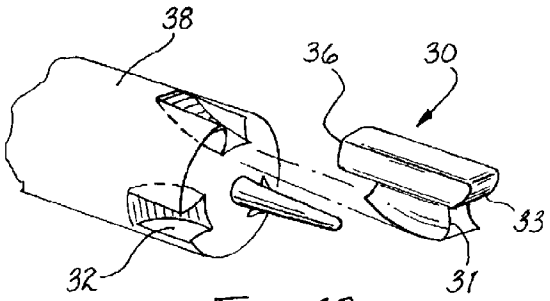
FIG. 13B is a perspective view showing the positioning of a locking lug in a slot in an inner bolt sleeve of the bolt.
Figure 12C:
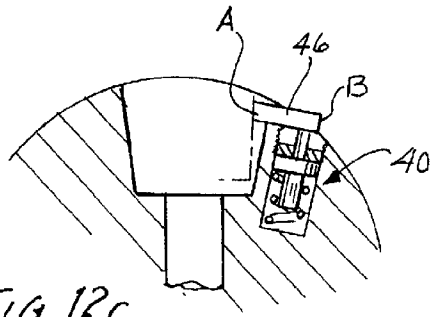
FIG. 12C is an end, cross-sectional view of locking lug and locking lug safety assembly with the locking lug removed.

Referring now to FIGS. 8–10, to maintain the bolt handle 20 in a raised position when retracted beyond the action—but to permit the bolt handle 20 to be lowered when the bolt 16 is moved fully forward—a bolt handle lock 52 is provided. The components of the bolt handle lock 52 are a t-shaped plunger 54, a spring 56 biased against the base of the plunger 54, and an opening 58 in a rear portion of the base of the bolt handle 20. The t-shaped plunger 54 is dimensioned to travel at an acute angle within a slot 60, which slot 60 is within a side projection on the rear bolt sleeve 92 (see FIG. 9) immediately behind and adjacent the bolt collar 21.

When the t-shaped plunger 54 is positioned by the spring 56 into its forward-most position, the forward-most portion of the plunger 54 enters the opening 58, preventing the bolt handle 20 from being lowered. When the t-shaped plunger 54 is retracted, the plunger 54 is withdrawn from the opening 58, permitting the bolt handle 20 to be lowered.

Figure 6:
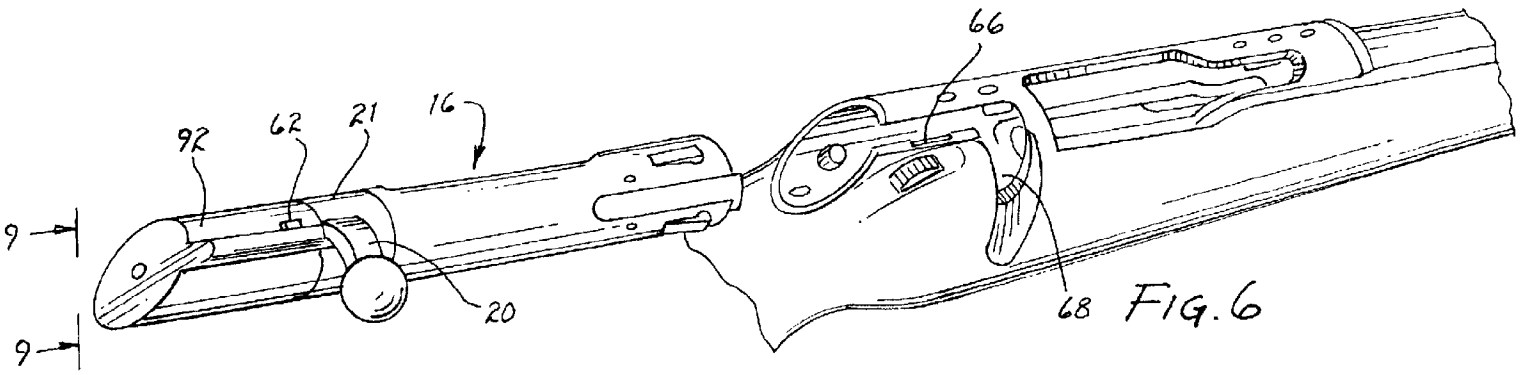
FIG. 6 is a fragmentary, perspective view of an embodiment of the bolt action rifle of the present invention, shown with the bolt removed.
Figure 7:
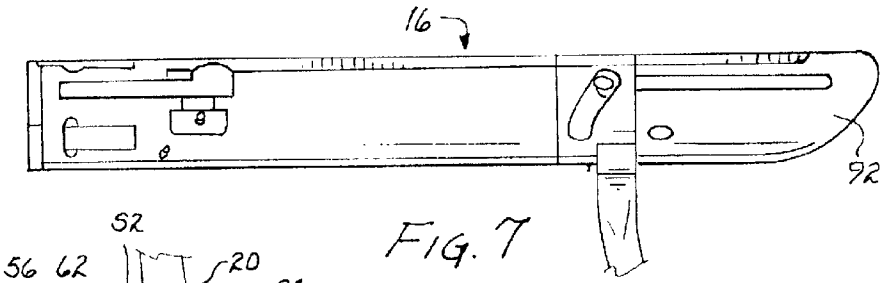
FIG. 7 is a side view of the bolt of an embodiment of the bolt action rifle of the present invention.

The t-shaped plunger 54 includes an upper projection 62 and a lower projection 64. When the bolt 16 is in the rearward or retracted position, the upper projection 62 will project above the surface of the side projection of bolt sleeve 92 (see FIG. 9), the lower projection 64 will not extend beyond the surface of the bolt sleeve 92, and the t-shaped plunger 54 will be in its forward-most position, locking the bolt handle 20 in the up position. As the bolt 16 is moved forward, the upper projection 62 will contact the rear of the receiver 17. This will cause the upper projection 62—and thus the entire t-shaped plunger 54 to be pushed rearward and downward. As this occurs, the lower projection 64 will project downward beyond the surface of the side projection of the bolt sleeve 92, and will enter a channel 66 located within the receiver 17. See FIGS. 6 and 10. As the bolt handle 20 moves along the receiver 17, it is prevented from closing until the bolt handle 20 reaches the bolt handle opening 68. At this point, with the plunger 54 retracted from the opening 58, the bolt handle 20 may be closed for firing. When the bolt handle 20 again is lifted and the bolt 16 is moved rearward, the lower projection 64 will reach the rearward end of the channel 66 and will be forced forward and upward causing the t-shaped plunger 54 to enter the bolt handle opening 58, locking the bolt handle 20 in the upright position. This is a backup to the action of the spring 56. While the presence of a lower projection 64 and channel 66 is preferable, it would be possible to eliminate these two features without departing from the spirit or scope of the present invention.

It should be noted that the bolt handle lock 52 described herein is exemplary of one embodiment of a means for locking the bolt handle 20 in the upright position. Other means may also be utilized without departing from the spirit or scope of the present invention.

Referring now to FIGS. 16–20, the magazine release feature of the rifle 10 is illustrated. The rifle 10 features a detachable magazine 24 (see FIG. 4), which magazine 24 holds and loads the cartridges (not shown) that are to be fired by the rifle 10. Detachable magazines are commonly used both with rifles and handguns. In the prior art, the release for the magazine operates from one side of the magazine, from below the magazine, or from other positions. However, prior art magazines do not provide release buttons on both the left and right sides of the magazine, allowing a user the flexibility of releasing the magazine from one side or the other depending on the conditions in which the rifle 10 is being used, or depending on whether the user is right-handed or left-handed.

The rifle 10 of the present invention has an ambidextrous magazine release 70. The main components of the magazine release 70 are a push button 72, preferably located in a front portion of the trigger guard 74 and projecting from both the right and left sides of the trigger guard 74 (see, e.g., FIG. 18). Preferably, for improved contact with the push button 72, the ends thereof are knurled.

Coupled to an upper surface of the push button 72 is a release catch 76. A bottom portion of the release catch 76 is preferably positioned within a slot 78 on the upper surface of the push button 72 as particularly shown in FIG. 19. At the front of the release catch 76, proximate the barrel 22 end of the rifle 10, is a bevelled projection 80. The bevelled projection 80 extends through an opening 82 in the portion 84 of the trigger guard surrounding the magazine body. The rear of the release catch 76, proximate the stock 12 end of the rifle 10, is concave. The concave area is dimensioned to mate with the convex forward surface of a plunger 86, the rear surface of which is biased against a spring 88.

The spring-loading of the release catch 76 via the plunger 86 tends to maintain the release catch 76 and push button 72 in a centered position. Located on the rear of the magazine 24 is a projection 79 (see FIG. 4). The projection 79 is positioned so that as the magazine 24 is inserted into the magazine housing 84, the projection 79 will slide up under the bevelled projection 80, passing on the bevelled side. As the projection 79 passes the bevelled projection 80, the bevelled projection 80 (and release catch 76) will be moved to the side. As the magazine 24 is fully inserted, the projection 79 will pass above the bevelled projection 80, allowing the spring 88 to force the release catch 76 back into its center position—below the projection 79. In this position, the bevelled projection 80 will hold the magazine 24 in place.

From this position, the magazine 24 is removed by pushing on either side of the push button 72. This will cause the bevelled projection 80 to move to one or the other side of the projection 79, permitting the magazine 24 to be withdrawn.

Figure 22A:
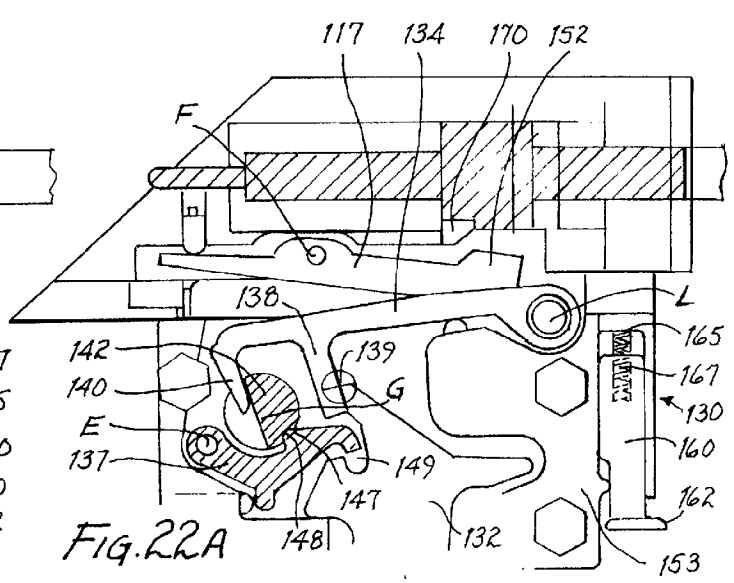
FIG. 22A is a partial side, cross-sectional view of the trigger mechanism of an embodiment of the bolt action rifle of the present invention.
Figure 21:
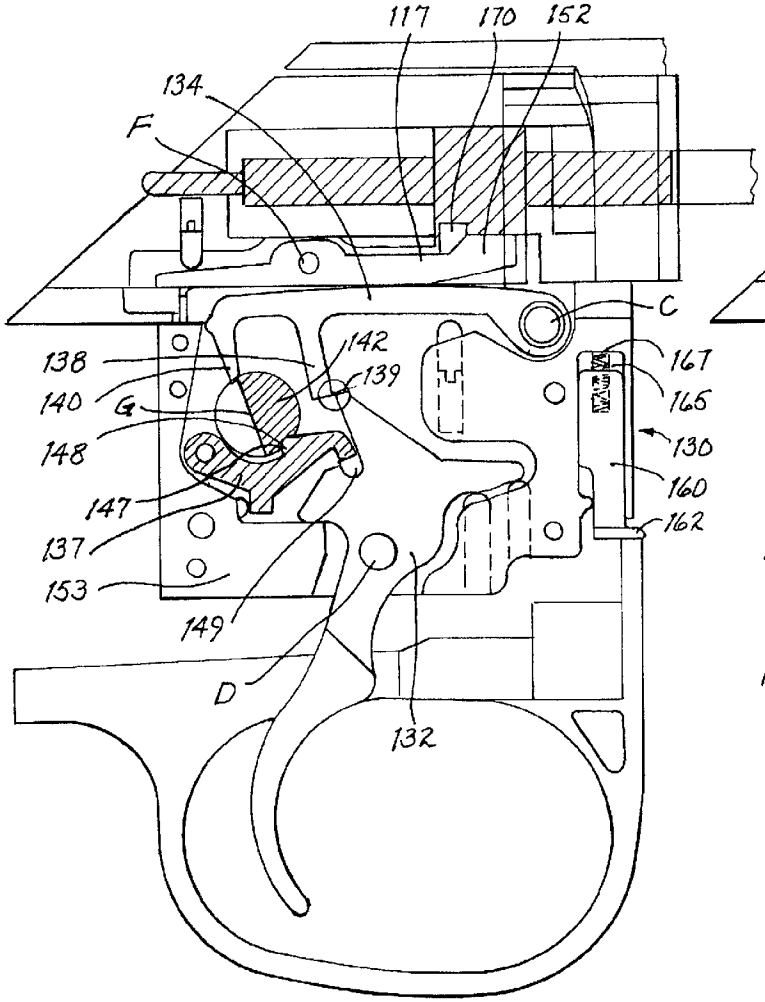
FIG. 21 is a side, cross-sectional view of the trigger mechanism of an embodiment of the bolt action rifle of the present invention.

Referring now to FIGS. 21 and 22A, the magazine ejector feature of the present invention is illustrated. The magazine ejector 160 is located within a slot 165 at the barrel 22 end of the trigger housing 153. The magazine ejector 160 is biased downward by a spring 167. The magazine ejector 160 further has an extension 162 that extends forward from the trigger housing 153. Extension 162 is positioned so that when the magazine 24 (see FIG. 4) is inserted into the magazine housing 84, the magazine projection 79 pushes against the extension 162.

When the magazine release mechanism 70 (see FIG. 20) is activated to release the magazine 24, the magazine 24 is forced at least partially downward by the spring 167 driving against the magazine ejector 160 and its extension 162, bearing downward on the magazine projection 79. This partial ejection allows the magazine 24 to be more easily grasped by the operator.

It should be noted that the ambidextrous magazine release 70 and/or magazine ejector 160 herein illustrated could be implemented in other magazine-fed firearms, including hand guns and other long guns, and not only on bolt action rifles. Where reference is intended to be made generically to guns of all types, terms such as "frame" are used in place of "stock," to convey such intent.

Turning now to FIGS. 26A–E, the bolt sleeve lock feature of the present invention is described. The bolt 16 comprises a number of component parts. Included among these are the outer bolt sleeve 34 and the rear bolt sleeve 92. The outer bolt sleeve 34 actually comprises two continuous cylindrical sections—a large diameter section 94 proximate the barrel 22 end of the rifle 10 and a smaller diameter section 96 proximate the stock end of the rifle 10. The smaller diameter section 96 has the bolt collar 21 positioned thereon, and the smaller diameter section 96 is threadably coupled at its stock end to the rear bolt sleeve 92.

Unless the rear bolt sleeve 92 is locked to the outer bolt sleeve 34, the rear bolt sleeve 92 may rotate when the bolt 16 is retracted. Such rotation is generally undesired because it could, among other things, harm the rear bolt sleeve 92 over time and prevent the bolt from returning to its position in the receiver 17 during cycling of the bolt 16. The present invention includes a bolt sleeve locking mechanism 98 to address this. Looking particularly at FIG. 26A, the locking mechanism 98 includes a sliding latch 100, having a horizontal long section 102, a vertical short section 104 projecting at a right angle from the long section 102 at an end thereof, and a horizontal short section 106 projecting at a right angle from the vertical short section 104 at an end thereof and extending beyond the end of the horizontal long section 102.

The sliding latch 100 is positioned within a cut-out portion of the rear bolt sleeve 92, with the horizontal long section 102 being flush with the outside surface of the rear bolt sleeve 92. A spring 108 (see FIG. 26C) is positioned at a rear of the horizontal long section 102 distal from the vertical short section 104. The spring 108 acts to bias the sliding latch 100 toward the barrel 22 end of the rifle 10. When biased forward, the horizontal short section 106 will enter a female notch 110 in the smaller diameter section 96, as shown for example in FIG. 26B–C. This positioning of the sliding latch 100 has the effect of locking the outer bolt sleeve 34 to the rear bolt sleeve 92, preventing the rear bolt sleeve 92 from rotating when the bolt 16 is retracted.

Figure 27:
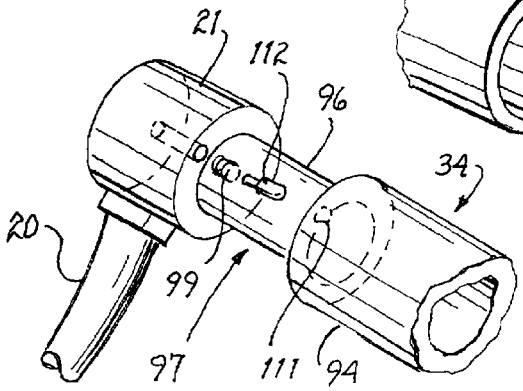
FIG. 27 is a perspective view of a bolt handle positioning mechanism of an embodiment of the bolt action rifle of the present invention.

Referring now to FIG. 27, the bolt handle positioning detent 97 of the present invention is illustrated. To prepare the rifle 10 for firing, a cartridge (not shown) is loaded into the chamber by the complete forward movement of the bolt 16, followed by the closing of the bolt handle 20. However, in this position, the force required to lift the bolt handle 20 is relatively minimal. It would be possible then for a user to inadvertently raise the bolt handle 20 even slightly, which could in turn cause the rifle 10 to misfire. It would be desirable then to provide a means for preventing the inadvertent raising of the bolt handle 20.

Inadvertent raising or opening of the bolt handle 20 is minimized by the positioning of a plunger 112 within the bolt collar 21. The plunger 112 is spring biased toward the barrel 22 end of the rifle 10 by spring 99, so that the forward end thereof enters a notch 111 in the larger diameter of the bolt body 94. When the bolt handle 20 is lowered, the plunger 112 enters the notch 111, preventing the bolt handle 20 from moving to the open position without the application of pressure. When it is desired to raise the bolt handle 20, for example after firing the rifle 10, the force applied by the user in purposefully pulling up on the bolt handle 20 will be sufficient to cause the forward end of the plunger 112 to move out of the notch 111—permitting the bolt handle 20 to be manipulated into the open position. The plunger 112 could also be positioned facing to the rear with the notch 111 positioned in the rear bolt sleeve 92. Still further, it would be possible to position the plunger 112 in the rear bolt sleeve 92 with the notch 111 in the rear face of the bolt collar 21.

Figures 24, 25A:
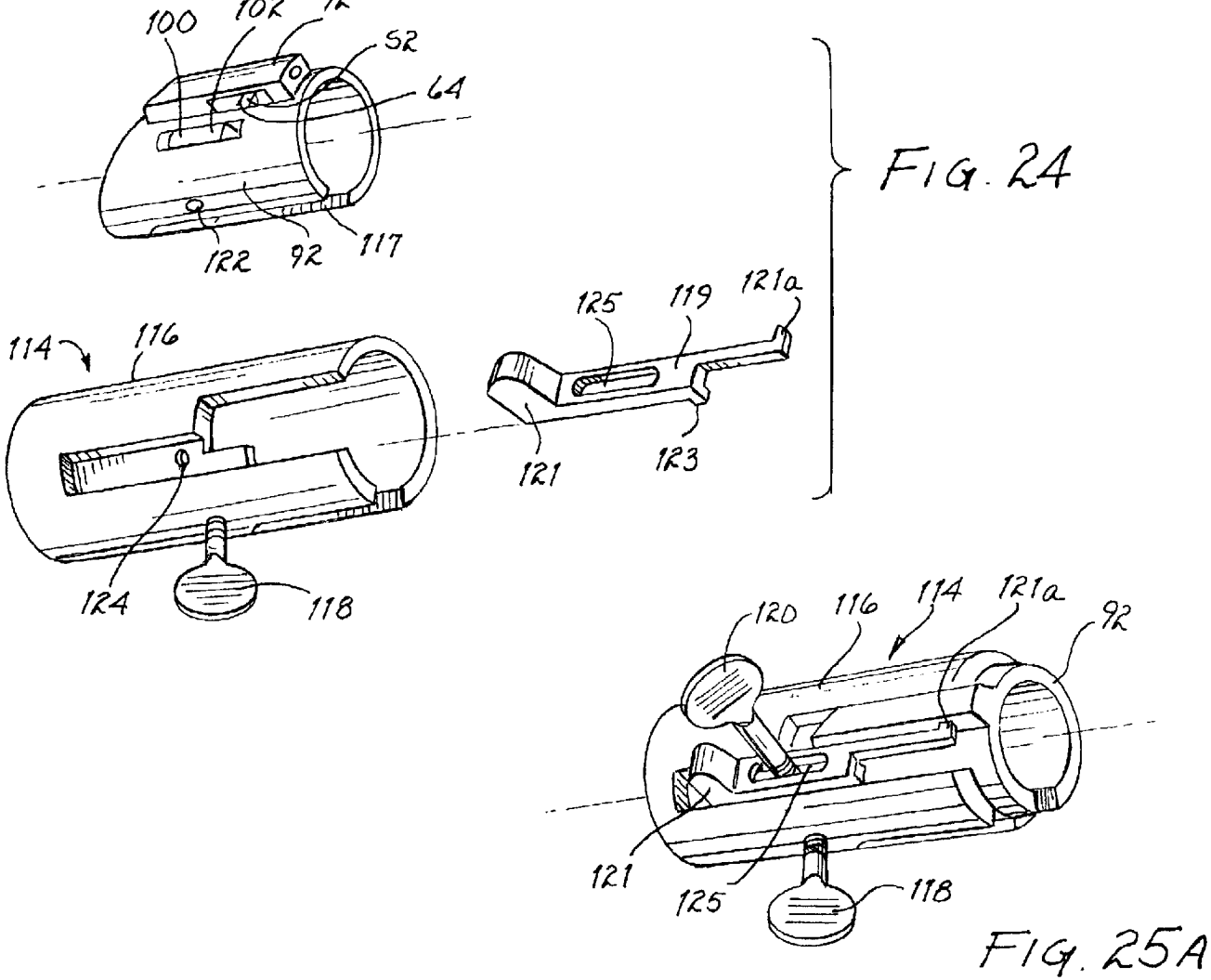
FIG. 24 is a perspective view of a bolt take-down tool and rear bolt sleeve of an embodiment of the bolt action rifle of the present invention.
FIG. 25A is a perspective view of the bolt take-down tool of FIG. 24 in position on the rear bolt sleeve of an embodiment of the bolt action rifle of the present invention.
Figure 25B:
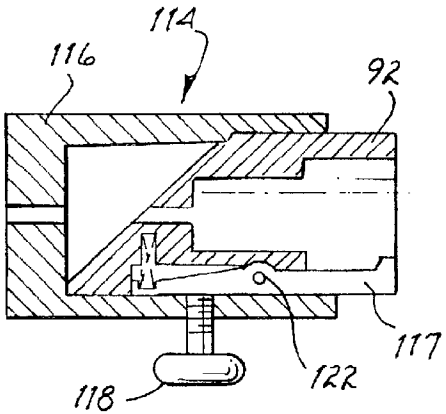
FIG. 25B is a side, cross-sectional view of the bolt take-down tool of FIG. 24 in position on the rear bolt sleeve of an embodiment of the bolt action rifle of the present invention.
Figure 25C:
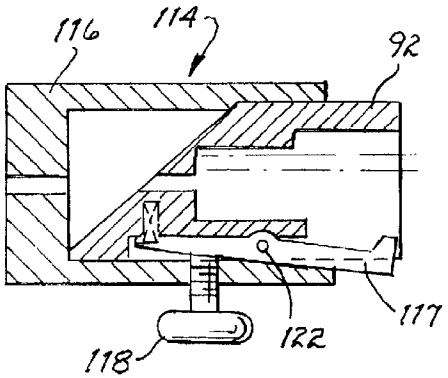
FIG. 25C is a side, cross-sectional view of the bolt take-down tool of FIG. 24 in position on the rear bolt sleeve of an embodiment of the bolt action rifle of the present invention.
Figure 26D:
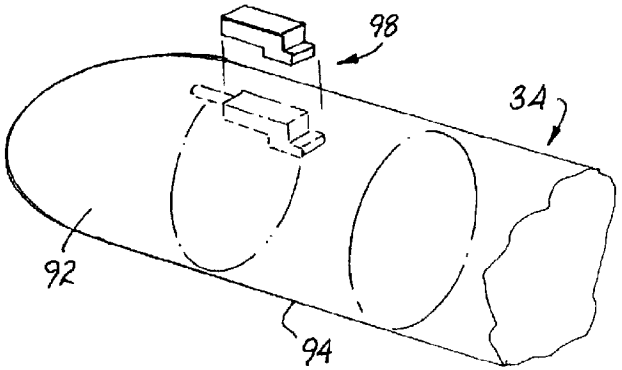
FIGS. 26D and 26E are views of the bolt sleeve lock feature.
Figure 26E:
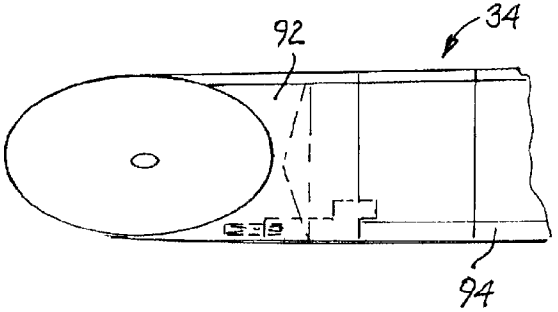

Referring now to FIGS. 24–25C, a bolt take-down tool 114 is shown. The bolt take-down tool 114 permits a user to readily dismantle the bolt 16, and in particular to separate the rear bolt sleeve 92 from the outer bolt sleeve 34. The bolt take-down tool 114 comprises a cylindrical body 116 that is closed at a first end and open at a second (see, e.g., FIGS. 25B–C). A thumbscrew 118 is threadably retained along the side of the cylindrical body 116 at a right angle thereto, and a thumbscrew 120 is threadably retained along the side of the cylindrical body 116 at a right acute angle thereto.

The cylindrical body 116 is dimensioned to fit over the rear bolt sleeve 92, until the closed end contacts the rearmost end of the rear bolt sleeve 92. When positioned in this manner, the bottom of the thumbscrew 118, when inserted into the cylindrical body 116, will contact and depress a rearward portion of the bolt sear 117. This will cause the bolt sear 117 to pivot about pin 122, rotating its front end out of engagement with the outer bolt sleeve 34. See FIG. 25C. Also requiring retraction to allow the rear bolt sleeve 92 to be unscrewed from the outer bolt sleeve 34 are the bolt handle lock 52 (see FIG. 10) and the sliding latch 100 (see FIGS. 26A–C).

Referring now to FIG. 24, shown is the sliding retractor 119. The sliding retractor 119 has at one end an operating projection 121 extending at a right angle to the sliding retractor 119. At the other end is a smaller right angle end extension 121*a* which is dimensioned to engage the front end of the lower projection 64 of the bolt handle lock 52 (see FIG. 10). A similar right angle middle extension 123 is dimensioned to fit at the forward end of the horizontal long section 102 of the sliding latch 100 (see FIG. 26A).

The sliding retractor 119 fits into a groove 124 on the side of the body 116 of the bolt take down tool 114. The sliding retractor 119 also has a center slot 125 through which a thumbscrew 120 passes and threads into a hole in the groove 124.

Referring to FIG. 25A, the sliding retractor 119 is operated with the thumbscrew 120 loosened to allow projections 121*a* and 123 to be maneuvered to a position in front of the lower projection 64 and the horizontal long section 102. The thumbscrew 120 is then partially tightened to allow only sliding motion of the sliding retractor 119. The sliding retractor 119 is then pulled rearward by the operation of projection 121. The thumbscrew 120 is then completely tightened locking the sliding retractor 119 and the sliding latch 100 and bolt handle lock 52 in their rearward position out of their locked position. This will then allow the rear bolt sleeve 92 to move independently of the outer bolt sleeve 34.

The combination of inserting each of the thumbscrew 118 and thumbscrew 120 in the manner herein described will permit the rear bolt sleeve 92 to be unscrewed from the outer bolt sleeve 34, and thus further allows disassembly of the bolt 16.

Attention is now directed to the trigger mechanism 130 of the present invention, illustrated in FIGS. 21, 22A–B and 23. The trigger mechanism 130 consists of a trigger sear 134 that pivots at its front end about point C. The mechanism 130 further comprises a trigger piece 132 that pivots about point D, the lower portion of which trigger piece 132 is pulled by the user to fire the rifle 10. The trigger sear 134 has two downwardly extending extensions—a rear extension 140 and a center extension 138. The center extension 138 can contact an engagement surface 139 at the top of the trigger piece 132. The rear extension 140 can contact a pivoting cam surface 142. The pivoting cam surface 142 is connected to the thumb piece 144 (see FIG. 4) and pivots about point G.

The orientation of the cam surface 142 is adjusted by forward and rearward movement of a thumb piece 144 (see, e.g., FIG. 1). A projection 147 from the safety pawl 137 contacts the cam surface 142. The cam surface 142 further comprises a notch 148 (see FIG. 23) thereon. The notch 148 is adapted to engage the safety pawl projection 147, which safety pawl 137 pivots at its rear end about point E. Forward or rearward movement of the thumb piece 144 causes up and down movement of the safety pawl projection 147, which causes up or down movement of the safety pawl 137. As shown in FIG. 22A, when the notch 148 is in the rearward, firing position, the notch 148 is rotated clockwise, allowing the projection 147 to enter the notch 148 and to pivot upward and out of engagement with the trigger piece notch 149. This same rotational closure movement of the cam surface 142 causes the rear extension 140 to be relieved from contact with the cam surface 142, allowing it to rotate downward about pivot point C, and moves the center extension 138 into contact with the engagement surface 139 at the top of the trigger piece 132. In this configuration, the trigger piece 132 is free to rotate forward about pivot point D, releasing the trigger sear 134 to rotate downward about pivot point C, which in turn allows the bolt sear 117 to rotate about pivot point F. This releases the firing pin 170, firing the rifle 10.

Figure 23:
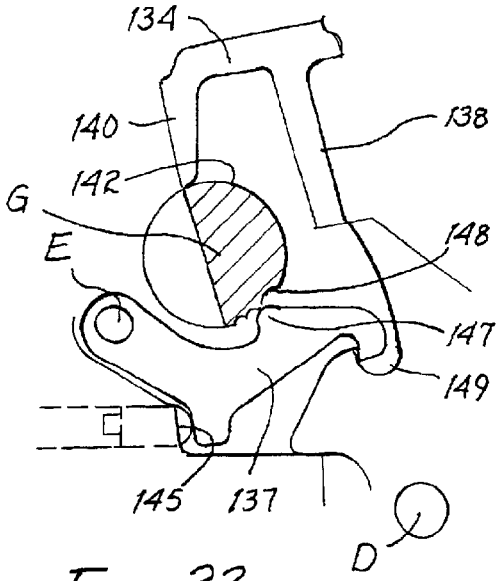
FIG. 23 is a partial side, cross-sectional view of the trigger mechanism of an embodiment of the bolt action rifle of the present invention.
Figure 26A:
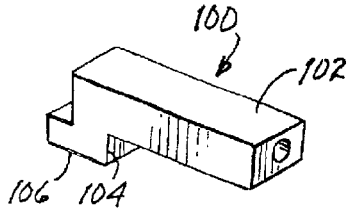
FIG. 26A is a perspective view of a sliding latch portion of a bolt sleeve locking mechanism of an embodiment of the bolt action rifle of the present invention.
Figure 26B:
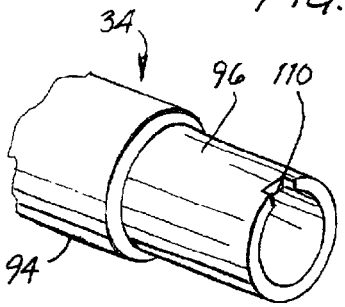
FIG. 26B is a perspective view of a portion of an outer bolt sleeve of an embodiment of the bolt action rifle of the present invention.
Figure 26C:
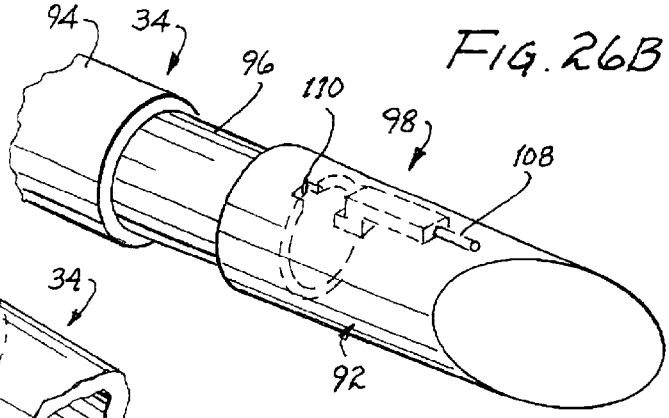
FIG. 26C is a perspective view of the outer bolt sleeve and rear bolt sleeve, illustrating coupling therebetween.

Full rearward movement of the thumb piece 144 places the gun in a full safe position, illustrated in FIG. 23. The cam surface 142 has been rotated counter-clockwise and the pawl projection 147 has been cammed from the notch 148. In this position, the safety pawl 137 engages the trigger piece notch 149. In addition, the center extension 138 is lifted from contacts with the engagement surface 139 by the camming action of the cam surface 142 on rear extension 140. In this configuration, the trigger sear 134 is prevented from moving downward, and the rifle 10 may not be fired. Because the trigger sear 134 is locked in position, the bolt sear 117 is also in the locked position (see also FIG. 4), with an extension 156 thereon engaging the bolt handle collar 21, preventing manipulation of the bolt handle 20.

In the middle position (not shown), the safety pawl 137 is still engaged with the trigger piece 132, and the rear extension 140 is in sufficient contact with the cam surface 142, so that the trigger sear 134 and the trigger piece 132 are locked. The extension 156 (see FIG. 4) is placed out of engagement with the bolt collar 21 allowing the bolt handle 20 to be manipulated.

Figure 22B:
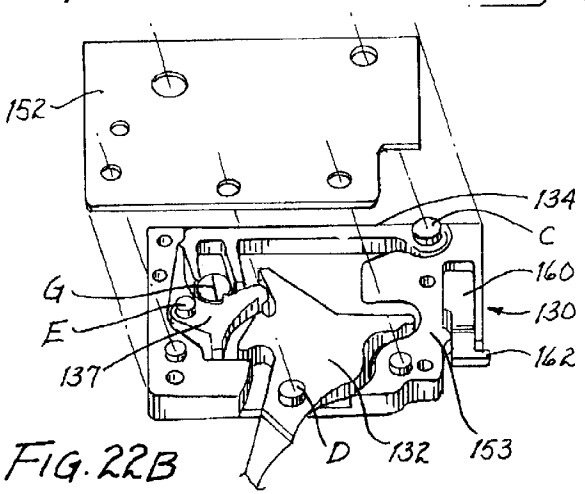
FIG. 22B is an exploded, perspective view of the trigger mechanism of an embodiment of the bolt action rifle of the present invention.

Each of pivot points C, D, and E are preferably cylindrical studs projecting from both sides of the trigger mechanism 130, and dimensioned to fit within mating holes on the facing plate 152 of the trigger mechanism 130 and in the trigger housing 153—as shown in FIG. 22B. The use of cylindrical studs is considered preferable over pivoting about pins, by eliminating the risk of a loosening of the part over time.

It should be noted that the trigger mechanism 130 herein illustrated could be implemented in other firearms, including hand guns and other long guns, and not only on bolt action rifles.

While the invention has been particularly shown and described with reference to preferred embodiments thereof, it will be understood by those skilled in the art that the foregoing and other changes in form and details may be made therein without departing from the spirit and scope of the invention. It should be noted that, without departing from the spirit or scope of the present invention, the improved firearm or bolt action rifle could implement only one feature herein described—for example only the split receiver ring 18—any combination of two or more of the features herein described—for example the split receiver ring 18 and trigger mechanism 130—or all of the herein described features.

I claim:

1. An improved bolt action rifle comprising, in combination:

a stock;

a receiver mounted in said stock;

a trigger assembly mounted in said receiver;

a receiver ring located at a forward end of said receiver;

a barrel located at a forward end of said receiver ring;

a bolt enclosed within said receiver and said receiver ring and adapted to travel forward and rearward within said receiver and said receiver ring;

wherein said bolt further comprises an inner bolt sleeve and an outer bolt sleeve surrounding said inner bolt sleeve;

at least one locking lug slot located within said inner bolt sleeve;

wherein said locking lug slot is concave;

at least one locking lug having an upper portion and a lower projection wherein said upper portion is dimensioned to be retained within a cavity in said outer bolt sleeve and wherein said lower projection is dimensioned to be mounted within said locking lug slot;

wherein said lower projection is convex;

wherein said lower projection has a dovetail shape when viewed in cross-section from an end thereof and wherein said locking lug slot has a mating dovetail shape when viewed in cross-section from an end thereof; and wherein said upper portion is dimensioned to contact a mating recessed area within said receiver ring during axial movement of said inner bolt sleeve relative to said outer bolt sleeve.

2. An improved bolt action rifle comprising, in combination:

a stock;

a receiver mounted in said stock;

a trigger assembly mounted in said receiver;

a receiver ring located at a forward end of said receiver;

a barrel located at a forward end of said receiver ring;

a bolt enclosed within said receiver and said receiver ring and adapted to travel forward and rearward within said receiver and said receiver ring;

wherein said bolt further comprises an inner bolt sleeve and an outer bolt sleeve surrounding said inner bolt sleeve;

at least one locking lug slot located within said inner bolt sleeve;

wherein said locking lug slot is concave;

at least one locking lug having an upper portion and a lower projection wherein said upper portion is dimensioned to be retained within a cavity in said outer bolt sleeve and wherein said lower projection is dimensioned to be mounted within said locking lug slot;

wherein said lower projection is convex;

wherein said lower projection has a T-shape when viewed in cross-section from an end thereof and wherein said locking lug slot has a mating T-shape when viewed in cross-section from an end thereof; and wherein said upper portion is dimensioned to contact a mating recessed area within said receiver ring during axial movement of said in ner bolt sleeve relative to said outer bolt sleeve.

3. An improved bolt action rifle comprising, in combination:

a stock;

a receiver mounted in said stock;

a trigger assembly mounted in said receiver;

a receiver ring located at a forward end of said receiver;

a barrel located at a forward end of said receiver ring;

a bolt enclosed within said receiver and said receiver ring and adapted to travel forward and rearward within said receiver and said receiver rug;

wherein said bolt further comprises an inner bolt sleeve and an outer bolt sleeve surrounding said inner bolt sleeve;

at least one locking lug slot located within said inner bolt sleeve;

wherein said locking lug slot is concave;

at least one locking lug having an upper portion and a lower projection wherein said upper portion is dimensioned to be retained within a cavity in said outer bolt sleeve and wherein said lower projection is dimensioned to be mounted within said locking lug slot;

wherein said lower projection is convex;

wherein said upper portion is dimensioned to contact a mating recessed area within said receiver ring during axial movement of said inner bolt sleeve relative to said outer bolt sleeve; and means for preventing full forward movement of said bolt within said receiver and said receiver ring when said upper portion of said at least one locking lug is not present within said cavity in said outer bolt sleeve.

4. The improved bolt action rifle of claim 3 wherein said prevention means comprises a spring-biased plunger positioned in said outer bolt sleeve, extending into said cavity in said outer bolt sleeve and extending above a surface of said outer bolt sleeve sufficiently to prevent full forward movement of said bolt within said receiver and said receiver ring when said upper portion of said locking lug is not present and wherein said plunger retracts to permit insertion of said locking lug and wherein, upon said retraction, descends below said surface of said outer bolt sleeve.

5. The improved bolt action rifle of claim 4 further comprising a channel located within said receiver and adapted to receive said plunger when said bolt is moved forward within said receiver and wherein said channel has a wall located at a forward-most portion thereof so as to contact said plunger and thereby prevent further forward movement of said bolt within said receiver and said receiver ring.

6. An improved bolt action rifle comprising, in combination:

a stock;

a receiver mounted in said stock;

a trigger assembly mounted in said receiver;

a receiver ring located at a forward end of said receiver;

a barrel located at a forward end of said receiver ring;

a bolt enclosed within said receiver a nd said receiver ring and adapted to travel forward and rearward within said receiver and said receiver ring;

wherein said bolt further comprises an inner bolt sleeve and an outer bolt sleeve surrounding said inner bolt sleeve;

at least one locking lug slot located within said inner bolt sleeve;

at least one locking lug having an upper portion and a lower projection wherein said upper portion is dimensioned to be retained within a cavity in said outer bolt sleeve and wherein said lower projection is dimensioned to be mounted within said locking lug slot;

wherein said upper portion is dimensioned to contact a mating recessed area within said receiver ring during axial movement of said inner bolt sleeve relative to said outer bolt sleeve; and means for preventing full forward movement of said bolt within said receiver and said receiver ring when said upper portion of said at least one locking lug is not present within said cavity in said outer bolt sleeve.

7. The improved bolt action rifle of claim 6 wherein said prevention means comprises a spring biased plunger positioned in said outer bolt sleeve, extending into said cavity in said outer bolt sleeve and extending above a surface of said outer bolt sleeve sufficiently to prevent full forward movement of said bolt within said receiver and said receiver ring when said upper portion of said locking lug is not present and wherein said plunger retracts to permit insertion of said locking lug and wherein, upon said retraction, descends below said surface of said outer bolt sleeve.

8. The improved bolt action rifle of claim 7 further comprising a channel located within said receiver and adapted to receive said plunger when said bolt is moved forward within said receiver and wherein said channel has a wall located at a forward-most portion thereof so as to contact said plunger and thereby prevent further forward movement of said bolt within said receiver and said receiver ring.

9. An improved bolt action rifle comprising, in combination:

a stock;

a receiver mounted in said stock;

a trigger assembly mounted in said receiver;

a receiver ring located at a forward end of said receiver;

a barrel located at a forward end of said receiver ring;

a bolt enclosed within said receiver and said receiver ring and adapted to travel forward and rearward within said receiver and said receiver ring;

wherein said bolt further comprises an inner bolt sleeve and an outer bolt sleeve surrounding said inner bolt sleeve and further comprising:

at least one locking lug slot located within said inner bolt sleeve;

wherein said locking lug slot is concave;

at least one locking lug having an upper portion and a lower projection wherein said upper portion is dimensioned to be retained within a cavity in said outer bolt sleeve and wherein said lower projection is dimensioned to be mounted within said locking lug slot;

wherein said lower projection is convex;

wherein said upper portion is dimensioned to contact a mating recessed area within said receiver ring during axial movement of said inner bolt sleeve relative to said outer bolt sleeve;

a first cut-out area in a side portion of said receiver ring;

wherein said first cut-out area is dimensioned and positioned to permit the ejection of a cartridge therethrough;

a second cut-out area in a bottom portion of said receiver ring;

wherein said second cut-out area is dimensioned and positioned to permit the feeding of a new cartridge from a magazine therebelow.

10. The improved bolt action rifle of claim 9 wherein said lower projection has a dovetail shape when viewed in cross-section from an end thereof and wherein said locking lug slot has a mating dovetail shape when viewed in cross-section from an end thereof.

11. The improved bolt action rifle of claim 9 wherein said lower projection has a T-shape when viewed in cross-section from an end thereof and wherein said locking lug slot has a mating T-shape when viewed in cross-section from an end thereof.

12. The improved bolt action rifle of claim 9 further comprising means for preventing full forward movement of said bolt within said receiver and said receiver ring when said upper portion of said at least one locking lug is not present within said cavity in said outer bolt sleeve.

13. The improved bolt action rifle of claim 12 wherein said prevention means comprises a spring-biased plunger positioned in said outer bolt sleeve, extending into said cavity in said outer bolt sleeve and extending above a surface of said outer bolt sleeve sufficiently to prevent full forward movement of said bolt within said receiver and said receiver ring when said upper portion of said locking lug is not present and wherein said plunger retracts to permit insertion of said locking lug and wherein, upon said retraction, descends below said surface of said outer bolt sleeve.

14. The improved bolt action rifle of claim 13 further comprising a channel located within said receiver and adapted to receive said plunger when said bolt is moved forward within said receiver and wherein said channel has a wall located at a forward-most portion thereof so as to contact said plunger and thereby prevent further forward movement of said bolt within said receiver and said receiver ring.

15. An improved bolt action rifle comprising, in combination:

a stock;

a receiver mounted in said stock;

a trigger assembly mounted in said receiver;

a receiver ring located at a forward end of said receiver;

a barrel located at a forward end of said receiver ring;

a bolt enclosed within said receiver and said receiver ring and adapted to travel forward and rearward within said receiver and said receiver ring;

wherein said bolt further comprises an inner bolt sleeve and an outer bolt sleeve surrounding said inner bolt sleeve and further comprising:

at least one locking lug slot located within said inner bolt sleeve;

at least one locking lug having an upper portion and a lower projection wherein said upper portion is dimensioned to be retained within a cavity in said outer bolt sleeve and wherein said lower projection is dimensioned to be mounted within said locking lug slot;

wherein said upper portion is dimensioned to contact a mating recessed area within said receiver ring during axial movement of said inner bolt sleeve relative to said outer bolt sleeve; and means for preventing full forward movement of said bolt within said receiver and said receiver ring when said upper portion of said at least one locking lug is not present within said cavity in said outer bolt sleeve a first cut-out area in a side portion of said receiver ring;

wherein said first cut-out area is dimensioned and positioned to permit the ejection of a cartridge therethrough;

a second cut-out area in a bottom portion of said receiver ring;

wherein said second cut-out area is dimensioned and positioned to permit the feeding of a new cartridge from a magazine therebelow.

16. The improved bolt action rifle of claim 15 wherein said prevention means comprises a spring biased plunger positioned in said outer bolt sleeve, extending into said cavity in said outer bolt sleeve and extending above a surface of said outer bolt sleeve sufficiently to prevent full forward movement of said bolt within said receiver and said receiver ring when said upper portion of said locking lug is not present and wherein said plunger retracts to permit insertion of said locking lug and wherein, upon said retraction, descends below said surface of said outer bolt sleeve.

17. The improved bolt action rifle of claim 16 further comprising a channel located within said receiver and adapted to receive said plunger when said bolt is moved forward within said receiver and wherein said channel has a wall located at a forward-most portion thereof so as to contact said plunger and thereby prevent further forward movement of said bolt within said receiver and said receiver ring.

* * * * *